United States Patent [19]

Dulondel et al.

[11] 4,367,863

[45] Jan. 11, 1983

[54] TORQUE LIMITER MEANS FOR CONTROLLING ROTARY MOTION

[76] Inventors: Jacques Dulondel, 1081 Saint-Viateur, Outremont, Prov. of Quebec, Canada, H2V 1Y6; Philippe R. de la Messuziere, 30 Zircon Crt., Willowdale, Ontario, Canada, M2H 2A1

[21] Appl. No.: 187,949

[22] Filed: Sep. 16, 1980

[51] Int. Cl.[3] ..... B66D 3/04

[52] U.S. Cl. ..... 254/391; 182/5; 188/290; 188/185; 188/303

[58] Field of Search ..... 254/391, 377; 182/5, 182/75, 236–239, 71; 74/55; 188/184, 185, 188, 303, 311, 322.22, 290; 242/99

[56] References Cited

U.S. PATENT DOCUMENTS

| | | | |
|---|---|---|---|
| 3,265,358 | 8/1966 | Delaney | 188/290 X |
| 3,513,713 | 5/1970 | Schumacher | 74/55 |
| 3,806,284 | 4/1974 | Jacobs | 74/55 X |
| 3,834,671 | 9/1974 | Buisson | 254/380 X |
| 4,173,332 | 11/1979 | Dulondel | 254/391 |
| 4,198,033 | 4/1980 | Messuziere et al. | 254/391 |

*Primary Examiner*—John M. Jillions

[57] ABSTRACT

A torque limiter means for controlling rotary motion is disclosed, comprising a casing, a shaft rotatively mounted in the casing, a pulley fixedly secured to the shaft and a coaxial rotor also secured to the shaft. The rotor has an odd number of radial cam projections which engage a pair of pins, these latter oscillating in transverse back and forth movement. A transversely oriented follower plate is rigidly secured to the pins and consequently also oscillates in back and forth movement thereby producing a braking action on the shaft.

5 Claims, 5 Drawing Figures

TORQUE LIMITER MEANS FOR CONTROLLING ROTARY MOTION

FIELD OF THE INVENTION

The present invention relates to a dynamic braking concept, more particularly to machines of the type using dynamic braking of a rotary component thereof, such as, for instance, in fire escape pulley devices.

BACKGROUND OF THE INVENTION

Dynamic braking is herein understood as the braking of a rotary element when produced in direct response to the rotational input to this element. This type of braking is most commonly used in fire escape pulley devices to limit the speed of rotation of the pulley and, thus, of descent of a person hanging on the cable of such devices.

The known fire escape devices produce dynamic braking by camming action of a rotor on movable bodies freely mounted between the rotor and braking segments. Consequently, the rotational speed of the rotor increases in direct proportion to the weight of a user hanging on the cable of such devices. This is clearly not satisfactory.

In our previous patents (U.S. Pat. No. 4,198,033 of Apr. 15, 1980 and Canadian Pat. No. 1,062,180 of Sept. 11, 1979), we have proposed a dynamically braked machine wherein the rotational speed limit increases as a function of the square root of the increase of a user's weight. The present invention disclosed herein uses a similar principle of torque limitation means and is an improved variation of our previous patents.

OBJECTS OF THE INVENTION

It is the first object of the present invention to provide a torque limiter means wherein the braking action increases as a function of the rotational speed of the rotary member to be braked to a greater extent than in the above-noted U.S. Pat. No. 4,198,033.

It is another object of the present invention to provide a dynamically-braked machine wherein the braking is effected by at least one cam-responsive unit.

It is a specific object of the present invention to apply the principle of a dynamically-limited torque machine to a practical and safe fire escape pulley device.

SUMMARY OF THE INVENTION

The above and other objects of the present invention are realized in accordance with a preferred embodiment, including a casing and an operative support plate, rigidly fixed to the former and projecting outwardly therefrom.

A pulley is rotatably mounted in the casing and engages a rope or cable, whose opposite ends extend downwardly through the bottom of the casing. The rope or cable includes a known type of stirrup or basket which a user embarks on to descend to the ground.

The pulley is coaxially arranged with a cam rotor having an odd number of indentations and corresponding protuberances. A cam-responsive plate is slidably mounted inside the casing, such that its motion is transverse to the axis of rotation of the pulley and rotor. This plate carries two cam follower pins which are actuated in a back-and-forth movement by the revolving rotor with which it is in contact at all times. Thus, the plate moves back and forth and brakes the rotor by the forces required to accelerate and decelerate the plate at the ends of its back-and-forth rectilinear movement. This plate also acts as a double piston, which compresses the air in the chamber ahead of it and the resulting resistance on the plate further brakes the rotor. Since the plate does not rotate, its braking force is greater than in the systems of our above-noted previous patents in which the reactive means rotate with the pulley.

The above will be more clearly understood by referring to the preferred embodiment of the invention illustrated, by way of the accompanying drawings, in which:

BRIEF DESCRIPTION OF THE DRAWINGS

Like numerals refer to like elements throughout the drawings.

DETAILED DESCRIPTION OF THE PREFERRED EMBODIMENT

Figure 1:
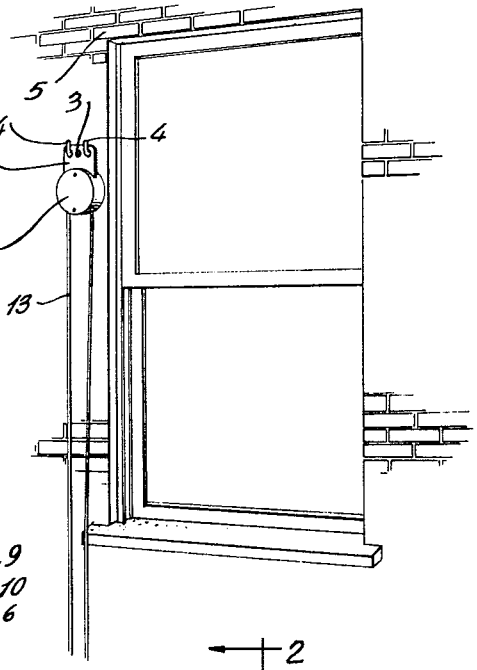
FIG. 1 is a perspective view of the rescuer device installed and ready for use beside the window of a building.
Figure 2:
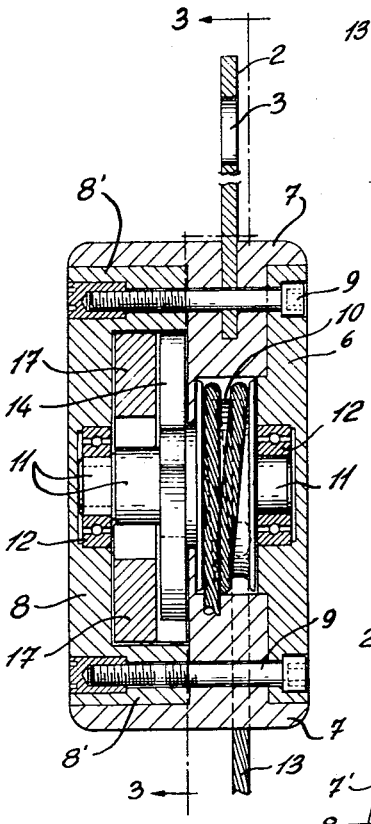
FIG. 2 is a cross-sectional side elevation of the rescuer device taken along line 2—2 of FIG. 3.

The rescuer device comprises a casing 1, generally cylindrical in shape. Casing 1 is provided with a rigidly secured operatively upright support plate 2 projecting from the top surface of casing 1 and secured therein by dowel pins 2'. This plate 2 has three laterally spaced-apart holes 3, whose purpose is to secure the rescuer device to the side of a building by means of hooks 4. These latter project outwardly from a wall 5, as shown in FIG. 1.

Casing 1 is formed of three different parts, including a front plate 6 which is round when seen in plan view, a main body 7 having a central circular cavity and a back plate 8, also round when seen in plan view, and having a frontwardly projecting peripheral portion 8' at its upper and lower ends. The purpose of this peripheral portion 8' is explained below.

Two bolts 9, one at the upper end and the other at the lower end of casing 1, rigidly secure the two plates 6 and 8 and the body 7 together.

A pulley 10 is mounted on, and secured to, a rotatable shaft 11 which extends transversely through the casing 1. The pulley 10 is located in the central, circular cavity of body 7 and the front and rear ends of shaft 11 rotate inside ball bearing assemblies 12 located in cavities formed in plates 6 and 8, respectively.

The rim of pulley 10 is knurled and a rope, or cable 13, is helically wound thereon. The opposite ends of the latter extend downwardly out of casing 1 through channels formed therefor in middle plate 7. A stirrup, or basket support, of any known type (not shown) is attached to cable 13, permitting a user of the rescuer device to descend to the ground.

Coaxially secured with the pulley 10 on shaft 11 and immediately rearward of pulley 10 is a cam rotor 14. Rotor 14 has an odd number of radial projections or cams 15 and a corresponding number of radial depressions 15'. Preferably there are five such cams 15, all equally spaced-apart around the circumference of rotor 14. The latter is removably secured to shaft 11 by means of a key and associated slot 16 for servicing.

Figure 3:
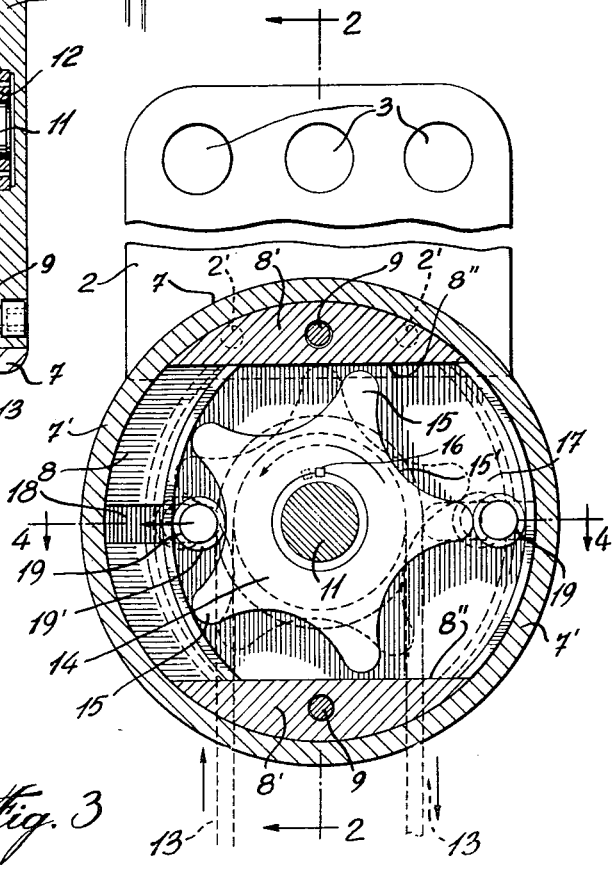
FIG. 3 is a sectional view taken along line 3—3 of FIG. 2.
Figure 4:
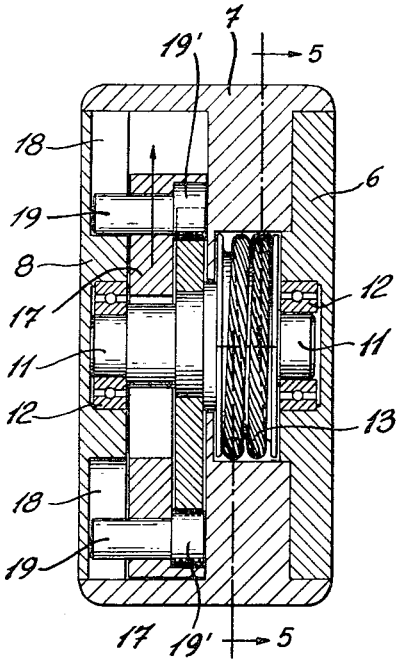
FIG. 4 is a plan cross-sectional view taken along line 4—4 of FIG. 5.

Immediately rearward, in turn, of rotor 14 is a follower plate 17 which is adapted to slide back and forth inside casing 1 in the two directions transverse to shaft 11. This movement is exercised between the lateral portions 7' of body 7 and the peripheral portions 8' of back plate 8. These portion 8' have horizontally flat inner surfaces 8'' as seen clearly in FIG. 3. The lateral arcs of curvature of the follower plate 17 correspond to the arc of curvature of the lateral portions 7'.

Back plate 8 is formed with two diametrically opposed and inwardly extending slots 18.

Through the follower plate 17 extend two longitudinally aligned cam follower pins 19. There is one such pin 19 guided in each slot 18. The head or frontmost part of each pin 19 carries a bushing 19' which is in camming contact with the periphery of rotor 14 at all times. Pins 19 are diametrically opposed with respect to the shaft axis.

The mode of operation of the torque limiter means will be obvious: as pulley 10 begins to revolve under the force exerted on cable 13 by a user, the follower plate 17 will begin to oscillate back and forth as the cam follower pins 19 themselves move back and forth (as suggested by the dashed outlines in FIG. 3) under the camming action of rotor 14. This oscillation of the follower plate 17 will brake the rotor because it acts against the torque of the revolving rotor each time it is accelerated and decelerated.

Figure 5:
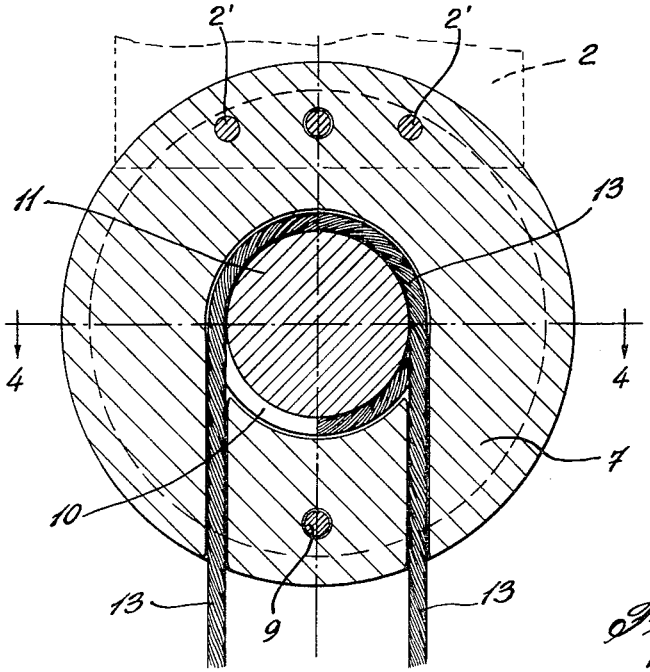
FIG. 5 is a sectional view taken along line 5—5 of FIG. 4.

It is to be noted that the exit holes for cables 13 are rounded as shown in FIG. 5 to prevent fraying of the strands of the cable in the event that casing 1 should tilt to one side under the weight of a user.

What we claim is:

1. A torque limiter means for controlling rotary motion comprising a casing, a shaft rotatably mounted in said casing, a pulley fixedly secured to said shaft and adapted to rotate therewith; said pulley carrying a cable; a rotor having an odd number of radially-disposed and equally spaced-apart cam projections defining an equal number of indentations, and also rigidly fixed to said shaft; a follower plate transversely oriented to said shaft and laterally displaceable relative to the same; two longitudinally-aligned cam follower pins carried by said follower plate and in contact with said rotor at all times, at two diametrically-spaced zones relative to the shaft axis, and rectilinear guide means formed by said casing and engaging the assembly of said follower plate and of said follower pins for restricting said follower plate to a rectilinear back-and-forth motion, whereby said shaft is braked by the force required to accelerate and decelerate said follower plate during its back-and-forth motion.

2. A torque limiter means as defined in claim 1, wherein said casing is formed of a front plate, a back plate and a main body disposed intermediate said front and back plates and having a central circular cavity in which said pulley is located.

3. A torque limiter means as defined in claim 2, wherein said rotor is arranged rearwardly of said pulley, said follower plate is arranged rearwardly of said rotor and the cam follower pins extend rearwardly of said follower plate, and wherein said back plate is formed with a pair of diametrically spaced-apart and inwardly-oriented rectilinear slots; said follower pins engaging and guided by said slots for back-and-forth rectilinear movement therein.

4. A torque limiter means as defined in claim 3, wherein said rotor has five equally spaced-apart cam projections and five corresponding indentations.

5. A torque limiter means as defined in claim 4, wherein said casing includes a rigidly secured operative support plate having at least one hole whereby said casing may be supported on the wall of a building.

* * * * *